US012509968B2

(12) United States Patent
Metzger et al.

(10) Patent No.: US 12,509,968 B2
(45) Date of Patent: Dec. 30, 2025

(54) SWAGING OF CHARGE TUBE FOR ATTACHMENT TO PERFORATING HARDWARE

(71) Applicant: Halliburton Energy Services, Inc., Houston, TX (US)

(72) Inventors: Jason Paul Metzger, Alvarado, TX (US); Matthew Kinter, Burleson, TX (US); Aaron James Bonner, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/218,480

(22) Filed: Jul. 5, 2023

(65) Prior Publication Data

US 2025/0012173 A1 Jan. 9, 2025

(51) Int. Cl.
*E21B 43/117* (2006.01)
*E21B 43/116* (2006.01)
*E21B 43/1185* (2006.01)

(52) U.S. Cl.
CPC ..... *E21B 43/117* (2013.01); *E21B 43/116* (2013.01); *E21B 43/1185* (2013.01)

(58) Field of Classification Search
CPC ..... E21B 43/117; E21B 43/116; E21B 43/16; E21B 43/119; E21B 43/1185
See application file for complete search history.

(56) References Cited

U.S. PATENT DOCUMENTS 7,278,491 B2 10/2007 Scott
9,145,763 B1 9/2015 Sites, Jr.
10,174,595 B2 * 1/2019 Knight ..... E21B 43/1185
10,273,788 B2 4/2019 Bradley et al.
11,098,563 B1 * 8/2021 Ludwig ..... E21B 43/119
11,326,442 B1 * 5/2022 Bryant ..... E21B 47/024
11,697,980 B2 * 7/2023 Goyeneche ..... F42B 3/02 175/4.57
11,795,791 B2 * 10/2023 Eitschberger ..... E21B 43/116
11,940,261 B2 * 3/2024 Sullivan ..... F42D 1/05
2006/0027397 A1 2/2006 Scott
2013/0037255 A1 2/2013 Kash et al.
2017/0115102 A1 4/2017 Knight et al.
2017/0275974 A1 9/2017 Von Kaenel et al.
2019/0195054 A1 * 6/2019 Bradley ..... F42D 1/04
(Continued)

FOREIGN PATENT DOCUMENTS

WO 2018191668 10/2018

OTHER PUBLICATIONS

International Search Report and Written Opinion for International Patent Application No. PCT/US2023/028528 dated Mar. 26, 2024. PDF file. 9 pages.

(Continued)

*Primary Examiner* — Yong-Suk (Philip) Ro

(74) *Attorney, Agent, or Firm* — John Wustenberg; C. Tumey Law Group PLLC

(57) ABSTRACT

A variety of charge tubes for perforating gun systems including, in one embodiment, a method attaching a charge tube, comprising swaging one or more ends of the charge tube to form at least one swaged end on the charge tube, wherein the charge tube comprises a plurality of charge ports; and coupling the at least one swaged end to a gun system component.

13 Claims, 7 Drawing Sheets

(56) References Cited

U.S. PATENT DOCUMENTS

| | | | | |
|---|---|---|---|---|
| 2021/0355795 | A1 | 11/2021 | Lane | |
| 2022/0403717 | A1* | 12/2022 | Wood | E21B 43/117 |

OTHER PUBLICATIONS

Halliburton, Velocity Performation System, Ply and play guns for pumpdown operations, 2021.
Hunting, H-2 Perforating system, Titan Division, 2019.

* cited by examiner

SWAGING OF CHARGE TUBE FOR ATTACHMENT TO PERFORATING HARDWARE

BACKGROUND

After drilling a wellbore in a subterranean formation for recovering hydrocarbons such as oil and gas lying beneath the surface, a casing string may be fed into the wellbore. Generally, the casing string protects the wellbore from failure (e.g., collapse, erosion) and provides a fluid path for hydrocarbons during production. To access the hydrocarbons for production, a perforating gun system may be deployed into the casing string via a tool string. The tool string (e.g., a tubing string, wireline, slick line, coil tubing) lowers the perforating gun system into the casing string to a desired position within the wellbore. Once the perforating gun system is in position such that shaped charges are disposed adjacent to a subterranean formation having hydrocarbons, the shaped charges are detonated. The detonation perforates the casing string, the cementing, and the subterranean formation such that hydrocarbons may flow into the casing string via the perforation. Moreover, once production operations have concluded, plug and abandonment operations may be conducted. Various methods may be used to abandon a wellbore. For example, a perforate-wash-cement method may be used. Such method includes perforating the casing, via a perforating gun system, to obtain access to the annulus between the casing and the wellbore wall, washing the annulus with fluids to help remove cement and debris, and pumping fresh cement into the annulus.

BRIEF DESCRIPTION OF THE DRAWINGS

These drawings illustrate certain aspects of some of the embodiments of the present disclosure and should not be used to limit or define the disclosure.

DETAILED DESCRIPTION

Figure 1:
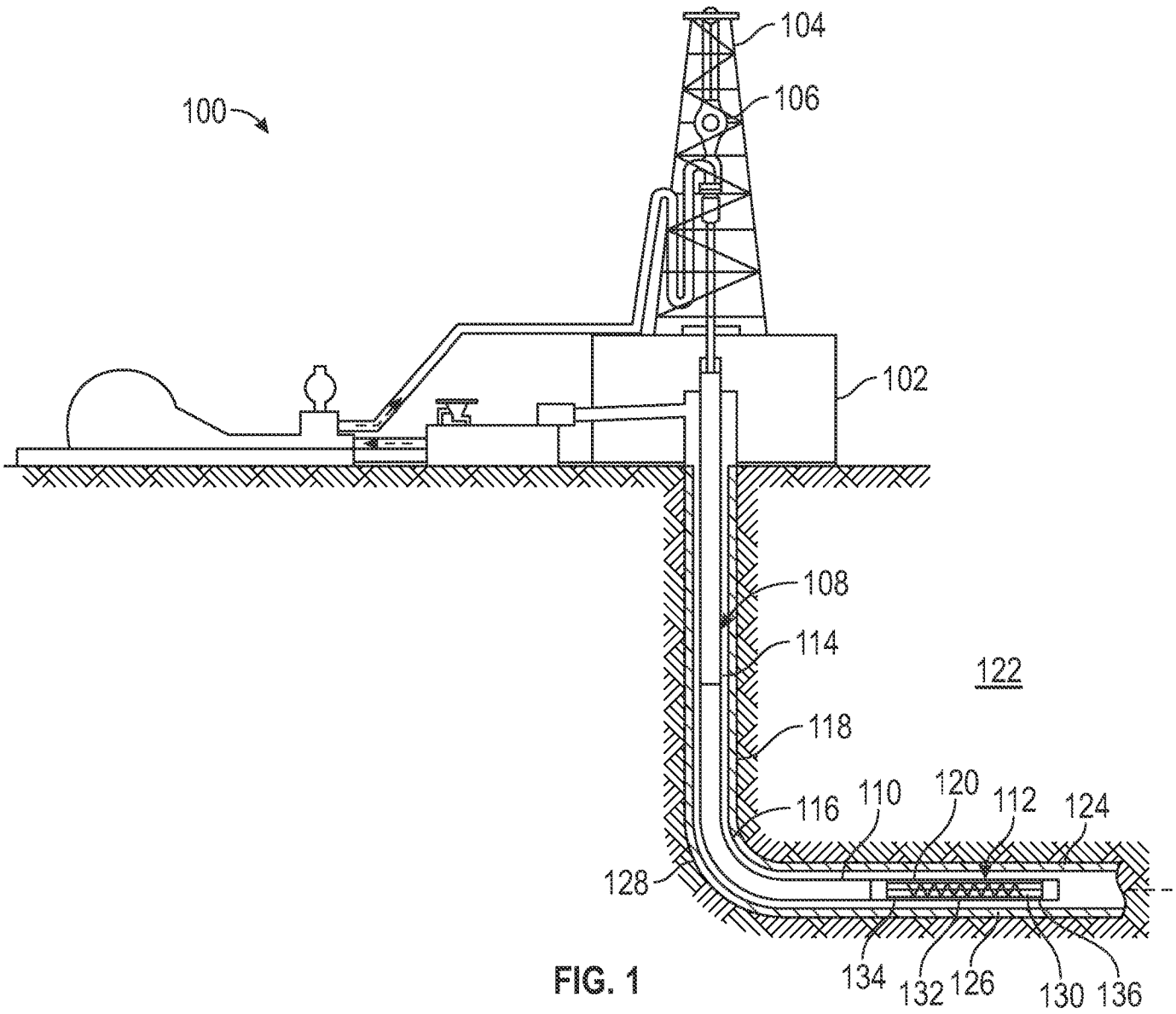
FIG. 1 is a side elevation, partial cross-sectional view of an operational environment for a drilling and completion system in accordance with one or more embodiments of the disclosure.

Disclosed herein are swaged charge tubes for use in perforating gun systems and, more particularly, example embodiments may include a charge tube having a swaged end to enable use of the charge tube with different perforating gun systems with modification of the gun systems' hardware.

A perforating gun system typically includes a number of components. For example, the perforating gun system may include a charge tube with a plurality of charge ports formed therein. The charge ports hold charges that detonate to send a jet outwardly to create perforations through the casing and cement sheath in the wellbore annulus. The charges may be shaped charges that restrict the explosive material of the charge in a conical configuration to direct the explosion. The perforating gun system may include a detonator housing that houses a detonator. Any suitable detonator may be used. For example, the detonator is typically an electro-explosive device that detonates when a specific electric signal is received. This detonation is then transferred to the detonation cord to start the perforating process. The detonator sends a detonation signal to the charges through a detonation cord, which may be coupled to the individual charges to trigger the charges. The detonation cord may direct, for example, a mechanical, electrical, or hydraulic control signal that triggers the charges in the event of detonation. The perforating gun may also include a switch housing that houses a switch. The switch may enable selective firing of the gun and charges. The switch may include one or more of a diode and pressure switch. In some examples, the switch may be an EB switch. The switch may also be an electronic switch, for example, a series of microprocesses. The perforating gun components may be positioned in a gun body that houses, for example, the charge tube and other gun components. End alignment fixtures may be secured to one or both ends of the charge tube for positioning the charge tube in the gun body.

Charge tubes often need to be used with larger or smaller gun systems with fixed hardware. For example, the fixed size of the gun systems components (e.g., end alignment fixtures, detonator housing, switch housing, etc.) may limit the ability to use existing charge tubes with differently sized gun systems. However, by swaging the end of the existing charge tube, an existing charge tube may be modified to allow an existing charge tube the adaptability to be used in differently sized gun systems with minimal re-engineering and design work.

In addition, the entire size (e.g., outer diameter, inner diameter) of a charge tube is limited based on the size of the shaped charge. For example, increasing the outer diameter of the entire charge tube can make holding a smaller shaped charge impossible without either modifying the shaped charge case or adding an adapter ring to hold the shaped charge in its desired location. However, when a swaging process is used to modify the charge tube, only the ends of the charge tube are modified, thus reducing the costs of additional charge tubes in inventor or associated hardware for modification of a new charge into an existing gun system.

In addition, an extensive supply chain of perforating gun components (e.g., charge tubes, end alignment fixtures, adapters, etc.) and the associated costs of this hardware may be required in inventory to enable ready production of a perforating gun system. However, by swaging charge tubes, multiple charge tubs can fit into the standard end alignments, detonator housings, and switch housings for each typical gun diameter. Advantageously, the supply chain may then be able to reduce the number of end alignment fixtures and adapters maintained in their inventory.

Accordingly, example embodiments may include swaging at least one end of a charge tube. In general, swaging is a process used to reduce or increase of tubes, such as the charge tube. Swaging process may use a die. For size reduction, the swaging may be performed using any suitable technique. For example, an end of the charge tube may be forced into a die that confines the charge tube end to reduces its diameter by compressive forces. By way of further example, two or more dies may be used to hammer the charge tube, reducing its diameter, in a process commonly referred to as a rotary swaging or rotary forging. The size reduction may be performed with or without a mandrel inserted into the charge tube. For size increase, the swaging may also be performed using any suitable technique. For example, a mandrel may be forced into an end of the charge to tube to increase its diameter by outward radial forces. By way of further example, two or more mandrels may be used. While is inserted into the charge tube, a die may be positioned around an exterior of the charge tube that applies radial force to the charge tube. In accordance with present embodiments, the swaging may be performed as cold forming processes (e.g., at ambient conditions) but swaging may also be performed as a hot-forming process (e.g., at elevated temperatures), in some embodiments.

Example embodiments may include identifying a gun system diameter. The gun system diameter may include an inner diameter and/or outer diameter of one or more gun system components, including, for example, a detonator housing, a switch housing, and/or an end alignment fixture. Example embodiments may include selecting a charge tube. The charge tube may be selected, for example, to have charge ports for holding a desired charge. The charge tube may be selected from a plurality of charge tubes with different diameter sizes. Example embodiments may further include swaging at least one end of the charge tube to match the gun system diameter, for example, by increasing or decreasing its diameter. The at least one end of the charge tube may be a pin end or a box end, for example. Example embodiments may further include coupling the charge tube a gun system component. For example, the charge tube may be directly coupled to a detonator housing, a switch housing, or an end alignment fixture. Any suitable technique may be used for coupling the charge tube to the gun system component. Suitable coupling techniques include screws, bolts, and pop rivets, among others. Examples embodiments may further include running the charge tube into a wellbore and detonating charges on the charge tube to create one or more perforations in the wellbore.

The swaging may be performed to adjust an inner diameter of at least one end of a charge tube by about 1% or more. For example, at least one end of the charge tube may be swaged to have an inner diameter that varies (e.g., larger or smaller) by about 1% to about 50% from an inner diameter of a central body of the charge tube. By way of further example, at least one end of the charge tube may be swaged to have an inner diameter that varies (e.g., larger or smaller) by about 10% to about 25% from an inner diameter of a central body of the charge tube. In some embodiments, both ends of the charge tube may be swaged to have an inner diameter that varies (e.g., larger or smaller) by about 1% to about 50% from an inner diameter of a central body of the charge tube. In some embodiments, at least one end of the charge tube may have an inner diameter that has been increased to vary by about 1% to about 50% or 10% to about 25% from an inner diameter of a central body of the charge tube. In some embodiments, at least one end of the charge tube may have an inner diameter that has been decreased to vary by about 1% to about 50% or about 10% to about 25% from an inner diameter of a central body of the charge tube.

In addition to adjusting an inner diameter, swaging of the charge tube may also adjust an outer diameter of at least one end of a charge tube end by about 1% or more. For example, at least one end of the charge tube may be swaged to have an outer diameter that varies (e.g., larger or smaller) by about 1% to about 50% from an outer diameter of a central body of the charge tube. In some embodiments, both ends of the charge tube may be swaged to have an outer diameter that varies (e.g., larger or smaller) by about 1% to about 50% from an outer diameter of a central body of the charge tube. By way of further example, at least one end of the charge tube may be swaged to have an outer diameter that varies (e.g., larger or smaller) by about 10% to about 25% from an outer diameter of a central body of the charge tube. In some embodiments, at least one end of the charge tube may have an outer diameter that has been increased to vary by about 1% to about 50% or about 10% to about 25% from an outer diameter of a central body of the charge tube. In some embodiments, at least one end of the charge tube may have an outer diameter that has been decreased to vary by about 1% to about 50% or about 10% to about 25% from an outer diameter of a central body of the charge tube.

The end of the charge tube that has been swaged may have a length that is about 0.4% to about 45% of a total length of the charge tube. For example, the length of the swaged end may be about 8% to about 35% of a total length of the charge tube.

FIG. 1 is a side elevation, partial cross-sectional view of an operational environment for a drilling and completion system in accordance with one or more embodiments of the disclosure. It should be noted that while FIG. 1 generally depicts a land-based drilling and completion assembly, those skilled in the art will readily recognize that the principles described herein are equally applicable to subsea drilling and completion operations that employ floating or sea-based platforms and rigs, without departing from the scope of the disclosure. As illustrated, the drilling and completion assembly 100 includes a platform 102 that supports a derrick 104 having a traveling block 106 for raising and lowering a tool string 108. The tool string 108 includes, but is not limited to, a work string 110, a perforating gun system 112, and any other suitable tools, as generally known to those skilled in the art. While not shown, tubing string, wireline, slick line, and/or coil tubing may be used instead of convention work string 110 for supporting the perforating gun system 112.

The work string 110 is configured to lower the perforating gun system 112 into a wellbore 114. As illustrated, the wellbore 114 may be lined with casing 116. The casing 116 is configured to protect the wellbore 114 from failure (e.g., collapse, erosion) and to provide a fluid path for hydrocarbons during production. To access the hydrocarbons, the work string 110 lowers the perforating gun system 112 to a position such that charges 120 (e.g., shaped charges) are disposed adjacent to a subterranean formation 122 having the hydrocarbons, and the perforating gun system 112 detonates the charges 120. In some embodiments, the charges 120 may be sequentially detonated by the perforating gun system 112 in a downhole to uphole direction or an uphole to downhole direction. The detonations perforate the casing 116, the cementing, and the subterranean formation 122 in the respective paths of the charge detonations such that hydrocarbons may flow into the casing 116 string via the perforations (not shown).

Generally, the perforating gun system 112 includes a central support structure 130 and the plurality of charges 120 (e.g., shaped charges) secured to the central support structure 130. The central support structure 130 may be supported directly by the work string 110. However, in the illustrated embodiment, the perforating gun system 112 includes a gun body 132 (e.g., gun carrier). The gun body 132 is configured to house a charge tube 134. The charge tube 134 generally has cylindrical shape. However, the charge tube 134 may have any suitable shape. Further, the perforating gun system 112 may include a plurality of end alignment fixtures 136 configured to mount the charge tube 134 within the gun body 132. The end alignment fixtures 136 may radially secure the charge tube 134 within the gun body 132 to prevent an exterior surface of the charge tube 134 from contacting an interior surface of the gun body 132. While not illustrated, the charge tube 134 may have at least one swaged end to facilitate connection to other components of the perforating gun system 112, such as the end alignment fixtures 136. For example, the charge tube 134 may have been swaged to increase or describe the inner and outer diameter of its end to facility connection to the end alignment fixtures 136. The central support structure 130 and the shaped charges 120 may be disposed within the charge tube 134. While not illustrated, additional components of the perforating gun system 112 may include one or more of a detonating cord, detonator housing, and switch housing.

Figure 2:
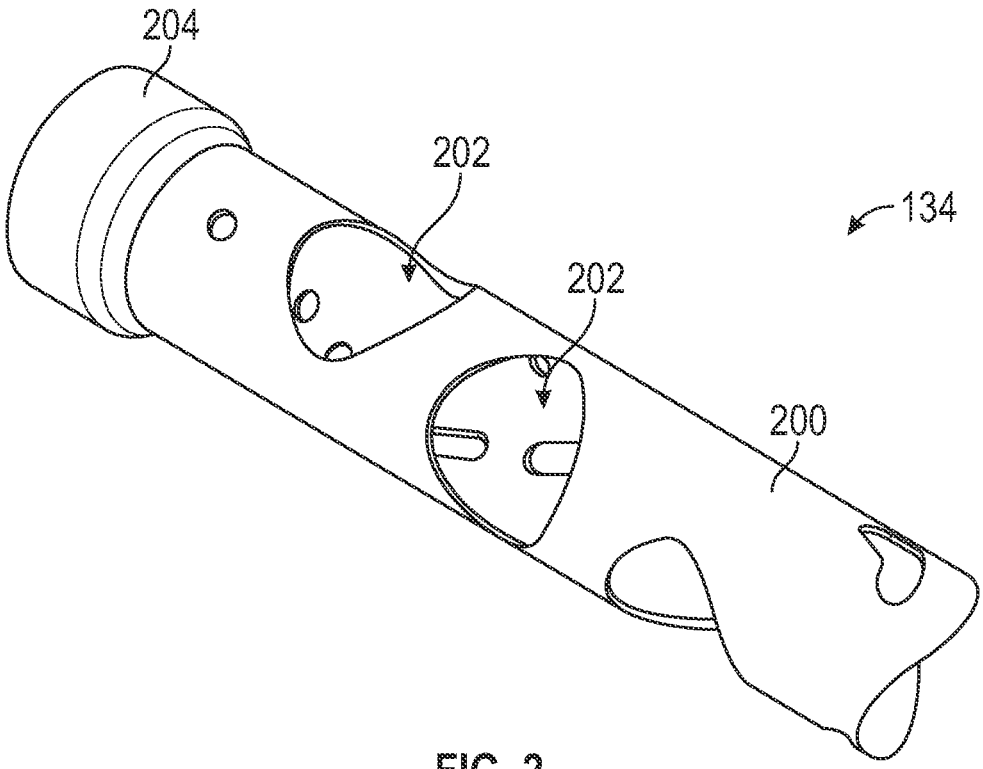
FIG. 2 is an isometric view of a charge tube having a swaged end that is enlarged in accordance with one or more embodiments of the disclosure.

FIG. 2 is an isometric view of a charge tube 134 in accordance with one or more embodiments. The charge tube 134 has a generally cylindrical shape, in this example, but may have other shapes in some embodiments. Th charge tube 134 includes a central body 200 that includes a plurality of charge ports 202 formed in the central body 200. As illustrated, the charged ports 202 may be axially spaced along the central body 200 and also circumferentially spaced around the central body 200. While not shown, charges (e.g., charges 120 on FIG. 1), which may be shaped charges, may be disposed in the charge ports 202. The charges, for example, may be positioned in the charge ports 202 prior to running the charge tube 134 into a wellbore (e.g., wellbore 114 on FIG. 1). In the illustrated embodiment, the charge tube 134 includes at least one swaged end 204. While only one end of the charge tube 134 is shown on FIG. 2, both ends of the charge tube 134 may be swaged in accordance with example embodiments. As illustrated, the swaged end 204 has an increased size with respect to the central body 200 of the charge tube 134. As previously described, swaging the charge tube 134 to provide the swaged end 134 allows the charge tube 134 to adapt to many different gun components without having to modify the original gun components. Rather, only the charge tube 134 was swaged to adapt the charge tube 134 to a particular gun system.

Figure 3:
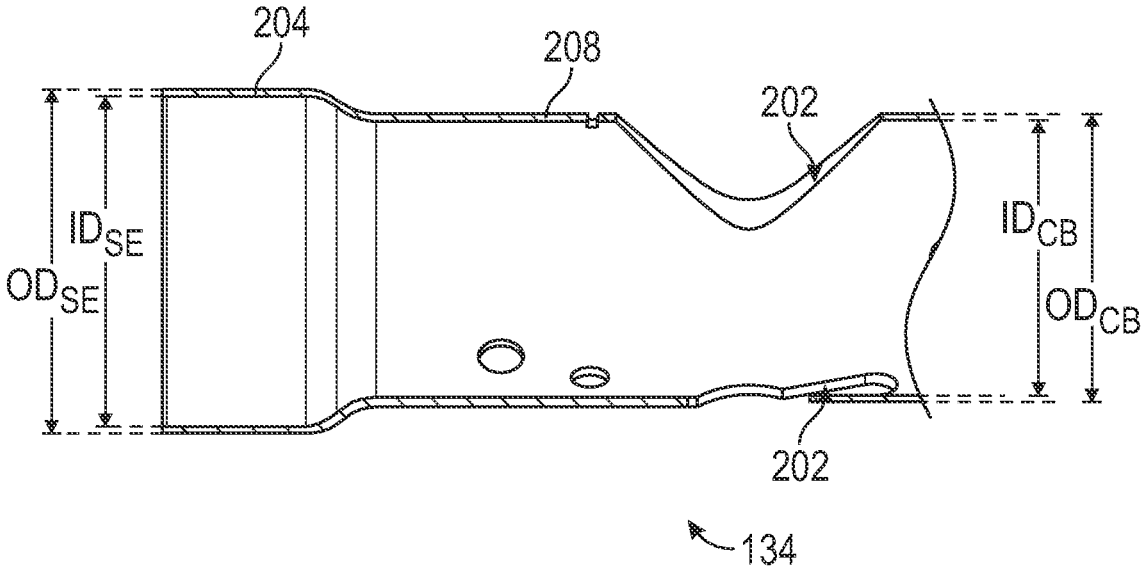
FIG. 3 is a cross-sectional view of the charge tube of FIG. 2 in accordance with one or more embodiments of the disclosure.

FIG. 3 is a cross-sectional view of the charge tube 134 of FIG. 2 in accordance with one or more embodiments. As illustrated, the charge tube 134 includes a central body 200 with charge ports 202. The charge tube 134 further includes a swaged end 204. As illustrated in the cross-sectional view, the swaged end 204 has an increased size with respect to the central body 200. For example, the swaged end 204 has an outer diameter ($OD_{SE}$) that is larger than an outer diameter ($OD_{CB}$) of the central body 200. As previously described, the swaged end 204 may have an outer diameter ($OD_{SE}$) that has been increased to vary by about 2%, about 5%, about 10%, or more from an outer diameter ($OD_{CB}$) of the central body 200. By way of further example, the swaged end 204 has an inner diameter ($ID_{SE}$) that is larger than an inner diameter ($ID_{CB}$) of the central body 200. As previously described, the swaged end 204 may an inner diameter ($ID_{SE}$) that has been increased to vary by about 2%, about 5%, about 10%, or more from an inner diameter ($ID_{CB}$) of the central body 200.

Figure 4:
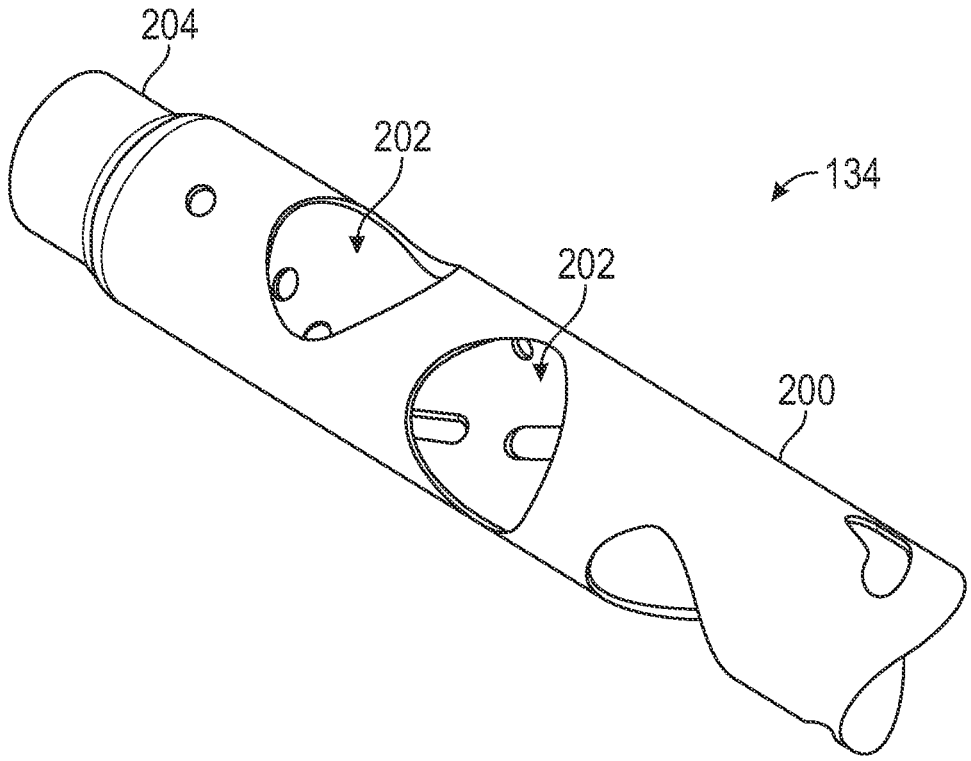
FIG. 4 is an isometric view of a charge tube having a swaged end that is reduced in accordance with one or more embodiments of the disclosure.

FIG. 4 is an isometric view of a charge tube 134 in accordance with one or more embodiments. The charge tube 134 has a generally cylindrical shape, in this example, but may have other shapes in some embodiments. The charge tube 134 includes a central body 200 that includes a plurality of charge ports 202 formed in the central body 200. As illustrated, the charged ports 202 may be axially spaced along the central body 200 and also circumferentially spaced around the central body 200. While not shown, charges (e.g., charges 120 on FIG. 1), which may be shaped charges, may be disposed in the charge ports 202. The charges, for example, may be positioned in the charge ports 202 prior to running the charge tube 134 into a wellbore (e.g., wellbore 114 on FIG. 1). In the illustrated embodiment, the charge tube 134 includes at least one swaged end 204. While only one end of the charge tube 134 is shown on FIG. 4, both ends of the charge tube 134 may be swaged in accordance with example embodiments. As illustrated, the swaged end 204 has a decreased size with respect to the central body 200 of the charge tube 134. As previously described, swaging the charge tube 134 to provide the swaged end 134 allows the charge tube 134 to adapt to many different gun components without having to modify the original gun components. Rather, only the charge tube 134 was swaged to adapt the charge tube 134 to a particular gun system.

Figure 5:
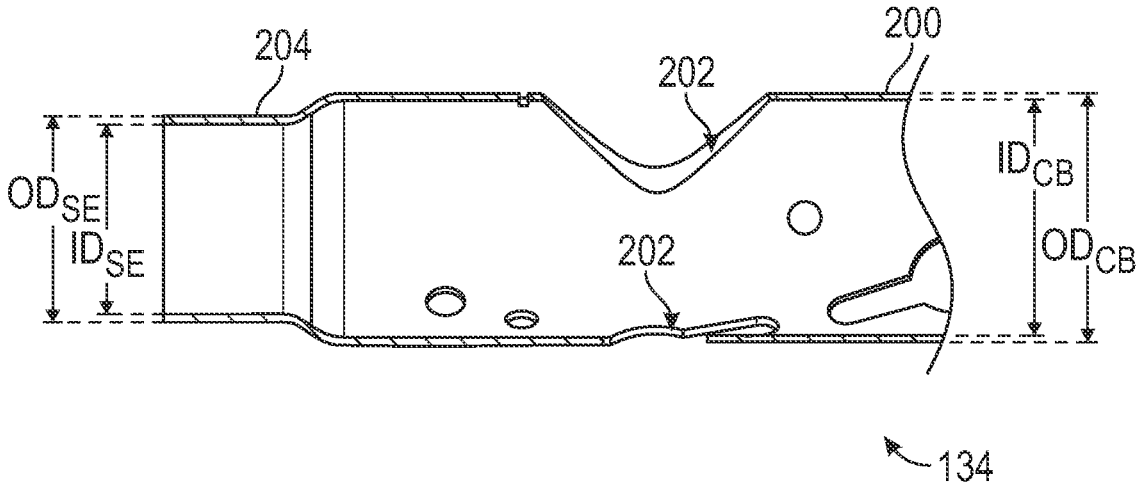
FIG. 5 is a cross-sectional view of the charge tube of FIG. 4 in accordance with one or more embodiments of the disclosure.

FIG. 5 is a cross-sectional view of the charge tube 134 of FIG. 4 in accordance with one or more embodiments. As illustrated, the charge tube 134 includes a central body 200 with charge ports 202. The charge tube 134 further includes a swaged end 204. As illustrated in the cross-sectional view, the swaged end 204 has a decreased size with respect to the central body 200. For example, the swaged end 204 has an outer diameter ($OD_{SE}$) that is smaller than an outer diameter ($OD_{CB}$) of the central body 200. As previously described, the swaged end 204 may have an outer diameter ($OD_{SE}$) that has been decreased to vary by about 2%, about 5%, about 10%, or more from an outer diameter ($OD_{CB}$) of the central body 200. By way of further example, the swaged end 204 has an inner diameter ($ID_{SE}$) that is smaller than an inner diameter ($ID_{CB}$) of the central body 200. As previously described, the swaged end 204 may an inner diameter ($ID_{SE}$) that has been decreased to vary by at least about 2%, about 5%, about 10%, or more from an inner diameter ($ID_{CB}$) of the central body 200.

Figure 6:
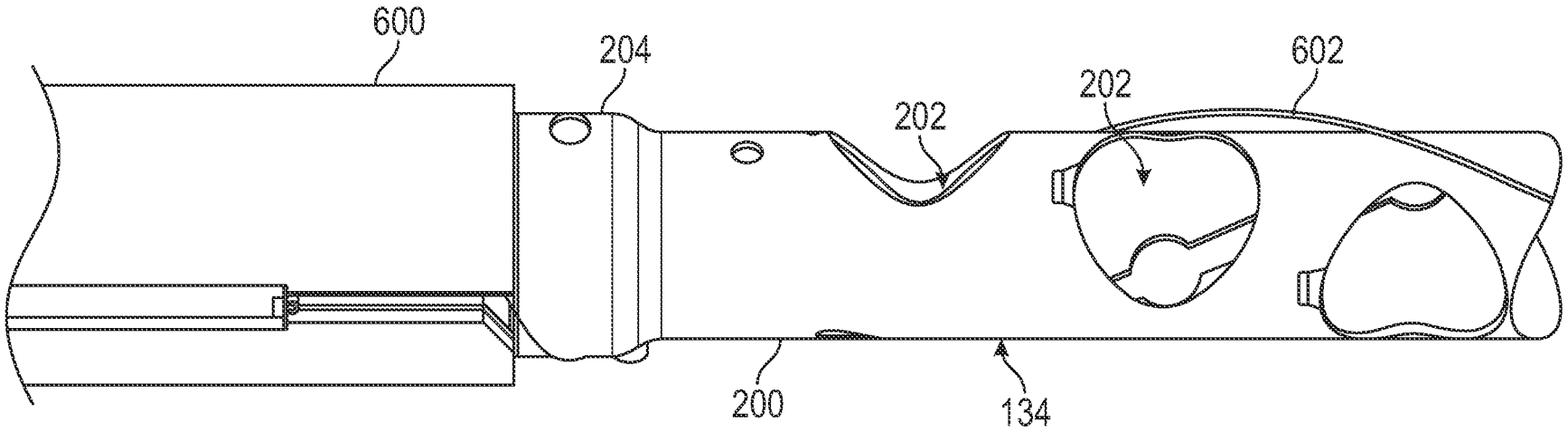
FIG. 6 is a side view showing a charge tube with a swaged end coupled to a gun component in accordance with one or more embodiments.

FIG. 6 is a side view illustrating a charge tube 134 secured to a gun component 600 in accordance with one or more embodiments. As illustrated, the charge tube 134 includes a central body 200 with charge ports 202. The charge tube 134 further includes a swaged end 204. A wire 602 is also shown that extends from the gun component 600 to the charge tube 134, for example, to provide communication with switches (not shown). As illustrated in the cross-sectional view, the swaged end 204 has an increased size with respect to the central body 200. By swaging to increase the size of the swaged end 204, the charge tube 134 may be secured to the gun component 600 with the need for its modification. The gun component 600 may include, for example, a detonator housing, a switch housing, or an end alignment fixture. Any suitable technique may be used for coupling the charge tube to the gun component 600. Suitable coupling techniques include screws, bolts, and pop rivets, among others.

Figure 7:
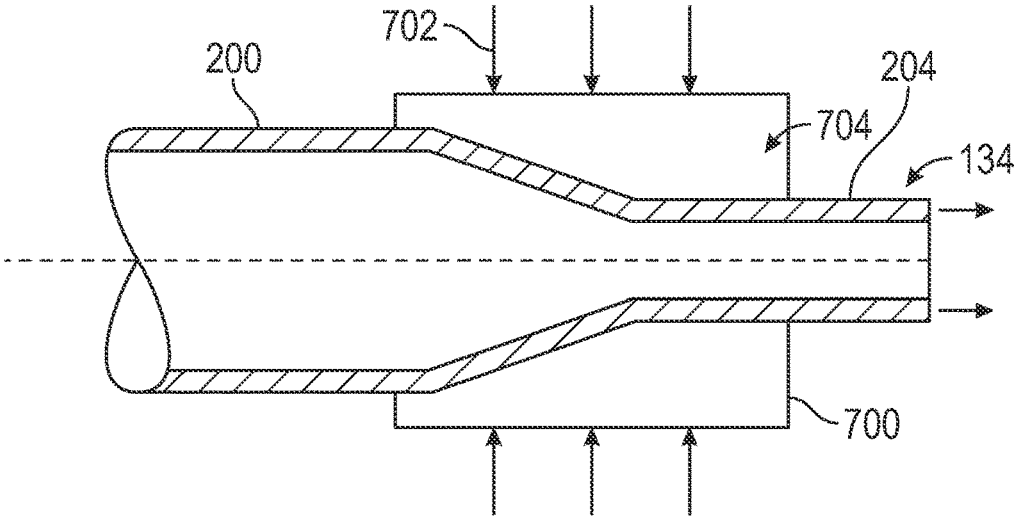
FIG. 7 is a cross-sectional, side view showing a charge tube disposed in a die in accordance with one or more embodiments.
Figure 8:
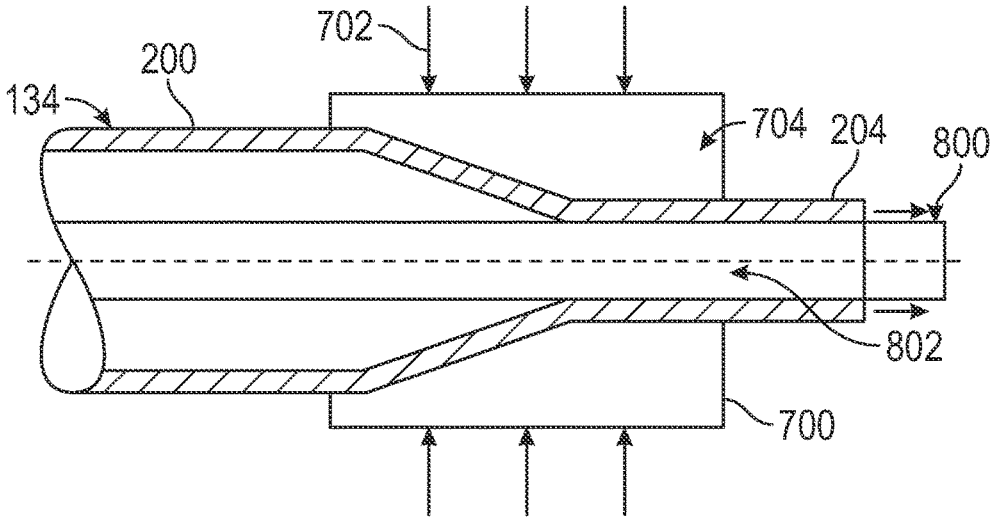
FIG. 8 is a cross-sectional, side view showing a charge tube disposed in a die and having a mandrel disposed therein in accordance with one or more embodiments.

FIG. 7 illustrates a technique for decreasing a size of at least one end of a charge tube 134 to form a swaged end 204 in accordance with one or more embodiments. As illustrated, the charge tube 134 may be inserted a die 700. The die 700 applies radial forces, as shown by arrows 702, onto the charge tube 134 to reduce an outer diameter of one end (i.e., swaged end 204) of the charge tube 134 with respect to a central body 200 of the charge tube 134. The charge tube 134 may be rotated in the direct shown by arrow 704 as it is inserted into the die 700. In some embodiments, a mandrel 800 may be inserted into a through passage of the charge tube 134 while the die 700 is applying the radial force 702, as shown by FIG. 8. The size and shape of the mandrel 800 may be selected, for example, to provide a swaged end 204 having a desired configuration.

Figure 9A:
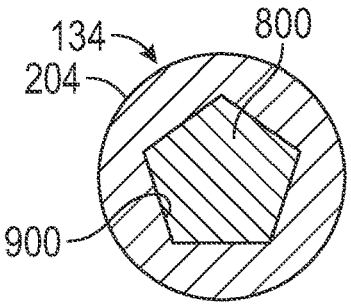
FIGS. 9*a* to 9*c* illustrate various mandrel configurations in accordance with one or more embodiments.
Figure 9B:
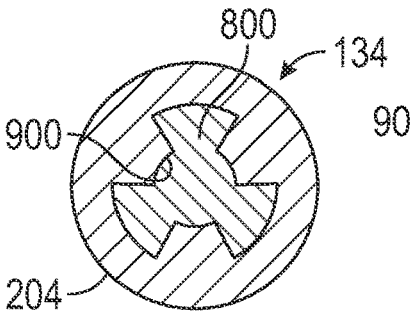
Figure 9C:
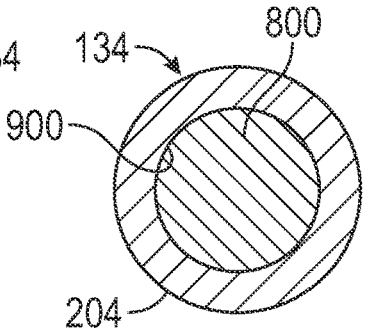

FIGS. 9*a* to 9*c* illustrate a cross-sectional end view of a mandrel 800 inserted into a charge tube 134 in accordance with one or more embodiments. As illustrated, the mandrel 800 mandrel may have a variety of different configuration, this imparting different shapes to an inner profile 900 of the swaged end 204 of the charge tube. FIG. 9*a* illustrates a mandrel 800 with a pentagonal cross-sectional shape. FIG. 9*b* illustrates a mandrel with a unique geometry. FIG. 9*c* illustrates a mandrel with a circular cross-sectional shape.

Figure 10:
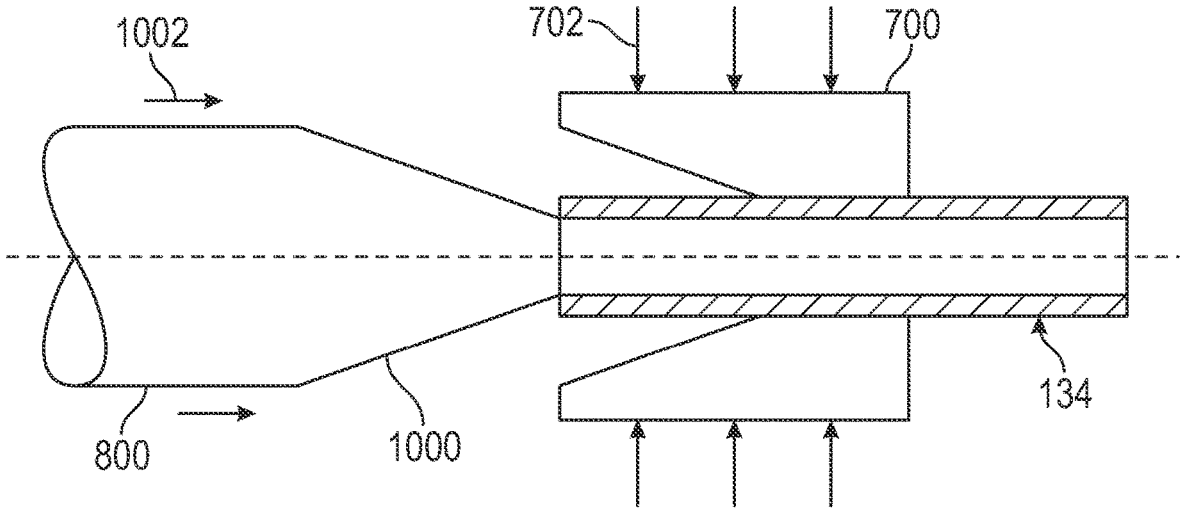
FIGS. 10 and 11 illustrate use of a mandrel to create a charge tube with a swaged end having an increased size in accordance with one or more embodiments.
Figure 11:
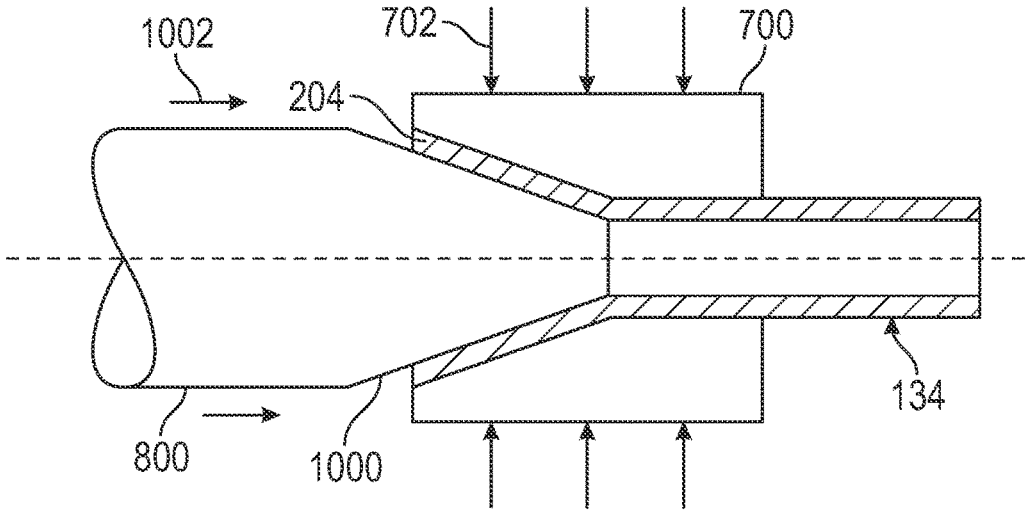

FIGS. 10 and 11 illustrate use of a die 700 to swage an end of a charge tube 134. As illustrated, on FIG. 10, a die 700 may be placed at least partially around the charge tube 134. The die 700 may apply a radial force to the charge tube 134, as illustrated by arrows 702. FIG. 10 also illustrates a mandrel 800. As illustrated, the mandrel 800 may have a ramped portion 1000. To swage the charge tube 134, the ramped portion 1000 of the mandrel 800 may be inserted into the charge tube 134 in the direction illustrated by arrows 1002. As shown on FIG. 11, the ramped portion 1000 may be pushed into the charge tube 134 to increase its inner diameter and form a swaged end 204. The size and shape of the mandrel 800 may be selected, for example, to provide a swaged end 204 having a desired configuration.

Figure 12:
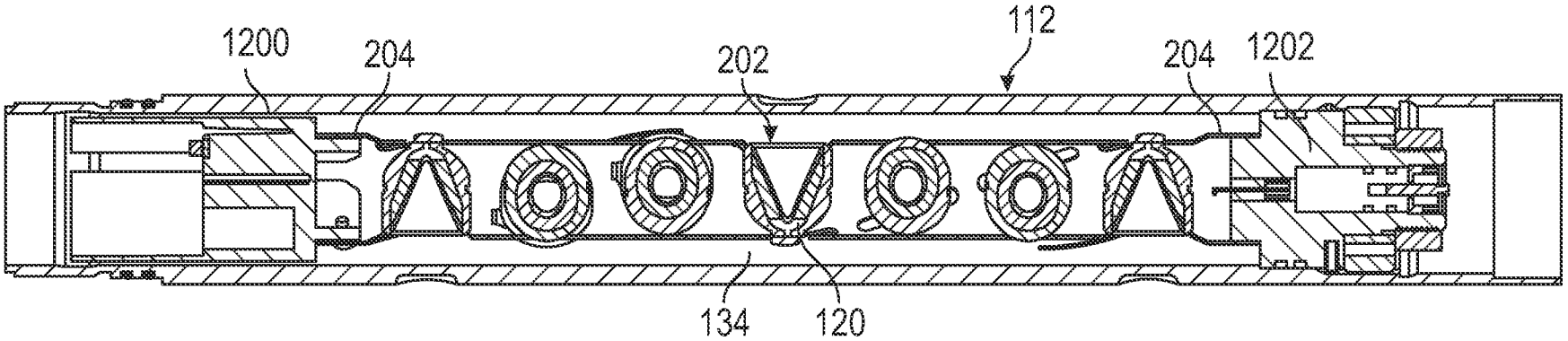
FIG. 12 is a cross-sectional, side view showing a perforation gun system, in accordance with one or more embodiments.

FIG. 12 illustrates a perforating gun system 112 having a gun tube 134 with swaged ends 204 in accordance with one or more embodiments. As illustrated, the perforating gun system 112 includes a gun body 132 (e.g., gun carrier) that houses the charge tube 134. The charge tube 134 generally has cylindrical shape. However, the charge tube 134 may have any suitable shape. The shaped charges 120 may be disposed within the charge ports 202 of the charge tube 134. Further, the perforating gun system 112 may include a plurality of fixtures that mount the charge tube 134 within the gun body 132. For example, a detonator housing 1200 containing a detonator (not shown) is shown secured to one end of the charge tube 134. By way of further example, the other end of the charge tube 134 is secured to a bulkhead 1202, for example, that contains an EB switch, feed through, and/or end alignment fixture. The end alignment fixtures 136 may radially secure the charge tube 134 within the gun body 132, for example, to prevent an exterior surface of the charge tube 134 from contacting an interior surface of the gun body 132. As illustrated, the charge tube 134 includes swaged ends 204 to facilitate connection to other components of the perforating gun system 112, such as the end alignment fixtures 136. For example, the charge tube 134 has been swaged to increase its inner diameter for connection to the end alignment fixtures 136. While FIG. 12 illustrates an increase of inner diameter, other embodiments may include swaging to decrease size as described herein. Even further, while FIG. 12 shows both ends of the charge tube 134 being swaged ends 204, embodiments may include only one end of the charged tube 134 being swaged.

Accordingly, the present disclosure may provide swaged charge tubes for use in perforating gun systems. The methods and systems may include any of the various features disclosed herein, including one or more of the following statements.

Statement 1. A method of attaching a charge tube, comprising swaging one or more ends of the charge tube to form at least one swaged end on the charge tube, wherein the charge tube comprises a plurality of charge ports; and coupling the at least one swaged end to a gun system component.

Statement 2. The method of statement 1, wherein the at least one swaged end has increased inner and outer diameters with respect to a central body of the gun tube.

Statement 3. The method of statement 1 or statement 2, wherein the at least one swaged end has decreased inner and outer diameters with respect to a central body of the gun tube.

Statement 4. The method of any one of statements 1 to 3, wherein the at least one swaged end has an inner diameter that varies by about 2% or more with respect to a central body of the gun tube.

Statement 5. The method of any one of statements 1 to 4, wherein the at least one swaged end has an outer diameter that varies by about 2% or more with respect to a central body of the gun tube.

Statement 6. The method of any one of statements 1 to 5, wherein the at least swaged end comprises both ends of the charge tube.

Statement 7. The method of any one of statements 1 to 6, wherein the gun system component comprises at least one component selected from the group consisting of a detonator housing, a switch housing, and an end alignment fixture.

Statement 8. The method of any one of statements 1 to 7, further comprising running a perforating gun system into a wellbore, wherein the perforating gun system comprises the charge tube secured to the gun component, wherein charges are disposed in the charge ports, and wherein the charge tube and gun component are housed in a gun body.

Statement 9. The method statement 8, further comprising detonating one or more of the charges to create perforations through a casing in the wellbore.

Statement 10. A method of modifying a charge tube, comprising: identifying a gun system diameter; selecting a charge tube from a plurality of charge tubes, wherein each of the charge tubes comprise charge ports; and swaging one or more ends of the charge tube to form at least one swaged end on the charge tube that has a diameter that is with about 1% of the gun system diameter.

Statement 11. The method of statement 10, wherein the at least one swaged end has increased inner and outer diameters with respect to a central body of the gun tube.

Statement 12. The method of statement 10 or statement 11, wherein the at least one swaged end has decreased inner and outer diameters with respect to a central body of the gun tube.

Statement 13. The method of any one of statements 10 to 12, wherein the at least one swaged end has an inner diameter that varies by about 2% or more with respect to a central body of the gun tube.

Statement 14. The method of any one of statements 10 to 13, wherein the at least one swaged end has an outer diameter that varies by about 2% or more with respect to a central body of the gun tube.

Statement 15. The method of any one of statements 10 to 14, wherein the at least swaged end comprises both ends of the charge tube.

Statement 16. The method of any one of statements 10 to 15, wherein the gun system diameter is a diameter of a gun system component, and wherein the method further comprises coupling the charge tube to the gun system component.

Statement 17. The method of statement 16, wherein the gun system component comprises at least one component selected from the group consisting of a detonator housing, a switch housing, and an end alignment fixture.

Statement 18. The method of statement 16 or statement 17, further comprising running a perforating gun system into a wellbore, wherein the perforating gun system comprises the charge tube secured to the gun component, wherein charges are disposed in the charge ports, and wherein the charge tube and gun component are housed in a gun body, and wherein the method further comprises detonating one or more of the charges to create perforations through a casing in the wellbore.

Statement 19. A perforating gun system comprising: a gun body; a gun system component housed in the gun body; and a charge tube housed in the gun body, wherein the charge tube comprises a central body having one or more charge ports that hold charges, and wherein the charge tube further comprises a swaged end, wherein the swaged end is coupled to the gun system component.

Statement 20. The perforating gun system of statement 19, wherein the swaged end has either an increased size or decreased size with respect to the central body, and wherein the gun system component comprises at least one component selected from the group consisting of a detonator housing, a switch housing, and an end alignment fixture.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A method of attaching a charge tube, comprising
swaging a first and a second end of the charge tube to form a first swaged end and a second swaged end on the charge tube, wherein the charge tube comprises a plurality of charge ports;
coupling the first swaged end to a bulkhead; and
coupling the second swaged end to a detonator housing.

2. The method of claim 1, wherein the at least one swaged end has increased inner and outer diameters with respect to a central body of the charge tube.

3. The method of claim 1, wherein the at least one swaged end has decreased inner and outer diameters with respect to a central body of the charge tube.

4. The method of claim 1, wherein the at least one swaged end has an inner diameter that varies by about 2% or more with respect to a central body of the charge tube.

5. The method of claim 1, wherein the at least one swaged end has an outer diameter that varies by about 2% or more with respect to a central body of the charge tube.

6. The method of claim 1, wherein the at least swaged end comprises both ends of the charge tube.

7. A perforating gun system comprising:
a detonator housing;
a gun body;
a gun system component housed in the gun body; and
a charge tube housed in the gun body, wherein the charge tube comprises comprising
a central body having one or more charge ports adapted to hold charges,
a first swaged end connected to the detonator housing; and
a second swaged end on the opposite side as the first swaged end; and
a bulkhead secured to the second swaged end.

8. The perforating gun system of claim 7, wherein the first swaged end has either an increased size or decreased size with respect to the central body.

9. The perforating gun system of claim 7 wherein:
the diameter of the first swaged end and the second swaged end is within about 1% of a diameter of the gun body.

10. The perforating gun system of claim 7 wherein:
the first swaged end and the second swaged end each have increased inner and outer diameters with respect to a diameter of the gun body.

11. The perforating gun system of claim 7 wherein:
the first swaged end and the second swaged end each have decreased inner and outer diameters with respect to a diameter of the gun body.

12. The method of claim 1, wherein:
the first swaged end and the second swaged end each have an inner diameter that varies by 2% or more with respect to a diameter of a gun body.

13. The method of claim 1, wherein:
the first swaged end and the second swaged end each have an outer diameter that varies by 2% or more with respect to a diameter of a gun body.

* * * * *